United States Patent [19]

Bianchini et al.

[11] Patent Number: 4,704,808

[45] Date of Patent: Nov. 10, 1987

[54] SHOE HAVING A RIGID BACK PART AND FLEXIBLE FOREPART

[75] Inventors: William L. Bianchini, Elmwood; Gary P. Duclos, Newburyport, both of Mass.

[73] Assignee: Highland Import Corporation, Marlboro, Mass.

[21] Appl. No.: 911,370

[22] Filed: Sep. 25, 1986

[51] Int. Cl.[4] ..... A43B 1/10; A43B 13/41; A43B 23/08

[52] U.S. Cl. ..... 36/102; 36/12; 36/43; 36/68; 36/69; 36/76 C

[58] Field of Search ..... 36/102, 68, 69, 43, 36/44, 76 C, 12, 14

[56] References Cited

U.S. PATENT DOCUMENTS

| | | | |
|---|---|---|---|
| 1,602,557 | 10/1926 | Steil | 36/68 X |
| 2,211,509 | 8/1940 | Lumbard | 36/43 |
| 2,232,767 | 2/1941 | Brophy | 36/76 C |
| 2,994,136 | 8/1961 | Reinhart et al. | 36/68 X |
| 3,785,915 | 1/1954 | Closson, Jr. | 36/68 |
| 4,231,169 | 11/1980 | Toyama et al. | 36/43 |
| 4,322,895 | 4/1982 | Hockerson | 36/69 X |
| 4,625,435 | 12/1986 | Ueda | 36/68 |

FOREIGN PATENT DOCUMENTS

| | | | |
|---|---|---|---|
| 323890 | 1/1935 | Italy | 36/68 |
| 318360 | 9/1929 | United Kingdom | 36/68 |

*Primary Examiner*—James Kee Chi

*Attorney, Agent, or Firm*—Wolf, Greenfield & Sacks

[57] ABSTRACT

A walking shoe having a uniquely shaped platform along the rear peripheral edge of the insole, which is constructed of a rigid backpart material and flexible forepart material. By combining it with a construction of a specially molded outflange counter and using a sturdy stitched lasting construction fastening securely the outward flange of the counter with the specially lasted molded leather upper together with the outward extension of the specially shaped insole platform, a stable support system is formed to control the lateral and longitudinal orientation of the foot when walking.

16 Claims, 7 Drawing Figures

SHOE HAVING A RIGID BACK PART AND FLEXIBLE FOREPART

INTRODUCTION

This invention relates to footwear and more particularly comprises a new and improved lightweight walking shoe.

Conventionally made lightweight shoes that may be used for walking or other similar activity frequently have relatively soft soles and are cement lasted. The counters have inwardly turned lasting flanges and therefore offer little resistance to roll over particularly because of the soft soles with which they are used.

One important object of the present invention is to provide a lightweight walking shoe with a soft outsole but which provides very substantial lateral stability to the foot.

More specifically, an important object of this invention is to provide a walking shoe which has great resistance to roll over, particularly at the back part of the shoe.

Another important object of the present invention is to provide a walking shoe which has very substantial fore and aft flexibility while providing great lateral stability.

To accomplish these and other objects, the walking shoe of the present invention includes an upper with a molded counter having an outwardly extending flange. The insole is provided with a wide lasting margin at the back part which accommodates the external counter flange. The upper leather is stitched to the flange of the counter and the margin of the insole and is wrapped about the edge of the insole to its bottom surface.

The shoe also includes a two piece insole having a flexible forepart and stiff back part. The forepart of the upper is cement lasted to the flexible forepart of the insole. The outwardly flanged counter and stiff insole cooperate to produce a back part which has great stability so as to resist roll over at the heel and twisting of the foot. The wrapped construction of the upper about the edge of the insole is most attractive. The stiff and stable back part does not interfere with the flexing of the forepart of the sole so that the shoe is suitable for vigorous activity.

These and other objects and features of the invention will be better understood and appreciated from the following detailed description of one embodiment thereof, read in connection with the accompanying drawings.

BRIEF FIGURE DESCRIPTION

DETAILED DESCRIPTION

Figure 1:
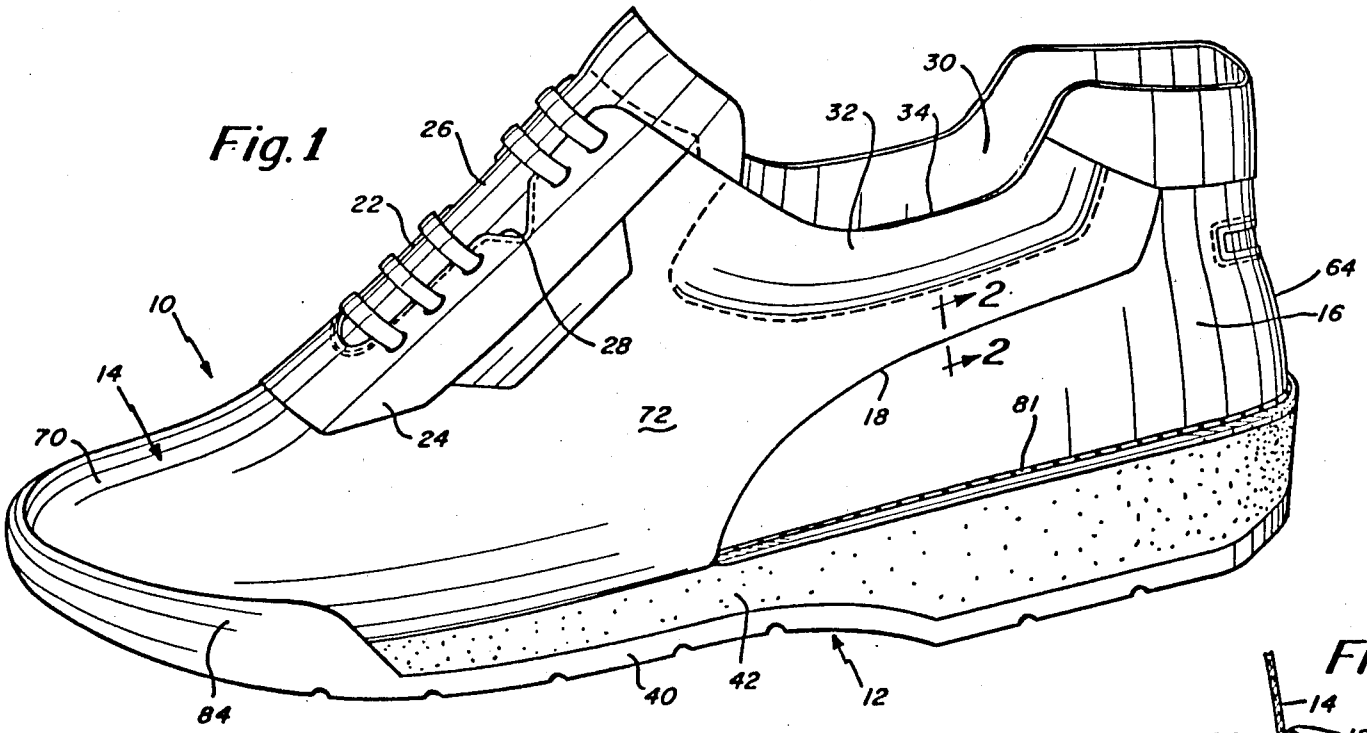
FIG. 1 is a perspective view of a walking shoe constructed in accordance with this invention.
Figure 2:
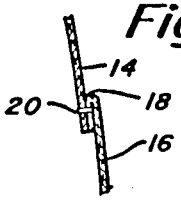
FIG. 2 is a fragmentary cross-sectional view thereof taken along section line 2—2 of FIG. 1.

The walking shoe shown in FIG. 1 includes an upper 10 and sole 12. The upper 10 has a vamp 14 and quarters 15 attached by a row of stitching 20 to the upper foxing 16 along the pattern line 18. In the embodiment shown, the seam 20 is hidden by a fold along the intersecting edge of the foxing 16 as illustrated in FIG. 2. The vamp 14 of the upper is provided with a lace opening 22 finished by an eye stay 24 and tongue 26. For comfort and flexibility, a notch 28 is provided in the lace opening 22 on each side thereof between the bottom and top of the opening. A lining 30 in the preferred embodiment is also stitched to the upper and extends about the inner surface of vamp 14 and quarters 15. The lining may be pig skin, fabric or other similar material, or combinations thereof. In the embodiment shown, a padded collar 32 is also provided about the upper edge 34 of the top of the upper to give increased comfort to the wearer.

Figure 3:
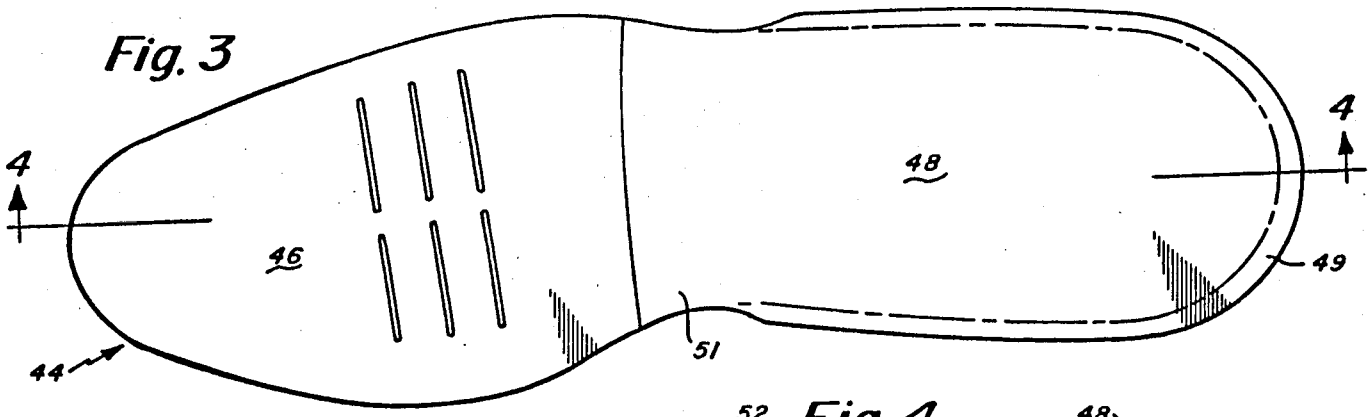
FIG. 3 is a bottom plan view of the insole of the shoe shown in FIG. 1.

The sole 12 includes an outsole 40, midsole 42 and insole 44. In accordance with the preferred embodiment of this invention, the insole is made of two pieces and combined as indicated in FIG. 3 just rearwardly of the ball of the foot. Insole 44 has a forepart 46 and a back part 48 whose adjacent edges are overlapped as shown in detail in FIG. 4. The overlapped adjacent edges 50 and 52 of the forepart and back part may be cemented together by any of the well known cement products used in the shoe industry. The forepart 46 of insole 44, typically may be made of Texon No. 485, which is quite flexible so as to reduce the stiffness of the sole at the forepart of the shoe. The back part 48 of the insole may be made of Texon T-90 which is a relatively firm material so as to impart stability to the back part of the insole. The back part 48 of the insole 44 is shown to have a wide margin 49 that extends from the rear of the shank area 51 about the heel. The margin 49 cooperates with the outwardly extending flange of the counter, as described below. The Texon products identified are manufactured by United Shoe Machine Corp. Obviously, other comparable materials may be used.

Figure 5:
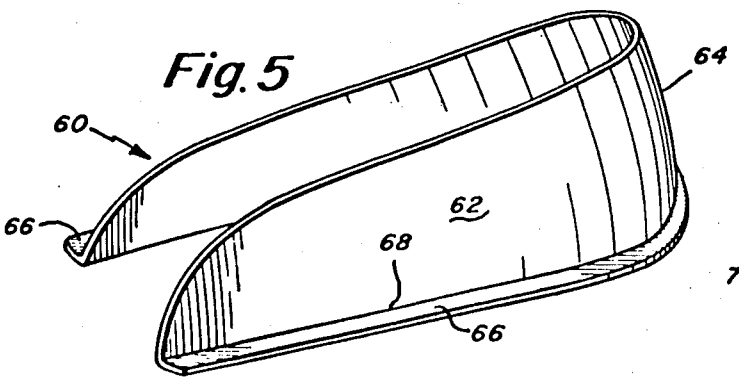
FIG. 5 is a perspective view of the molded counter which forms part of the shoe.

In FIG. 5, a molded counter 60 is shown that is incorporated into the upper of the shoe at the quarters 15 between the foxing 16 and the lining 30. The counter 60 is generally U-shaped when viewed from above and has a relatively stiff side wall 62 which extends about the heel portion of the upper and diminishes in height toward the forepart from the back stay 64 of the shoe. The counter has an outwardly extending flange 66 about its lower edge 68 that forms a lasting margin to assemble the shoe as is described in detail below. During the assembling of the upper 10, the counter is inserted between the foxing 16 and the lining 30. The flange 66 plays a major roll in imparting lateral stability to the shoe to reduce the danger of twisting the foot or ankle of the wearer.

Figure 6:
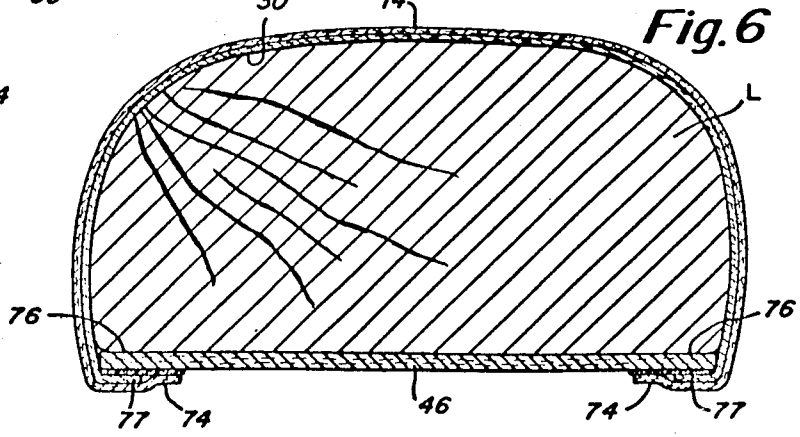
FIGS. 6 and 7 are cross-sectional views through the forepart and back part of a partially assembled shoe on a last, constructed in accordance with this invention.
Figure 7:
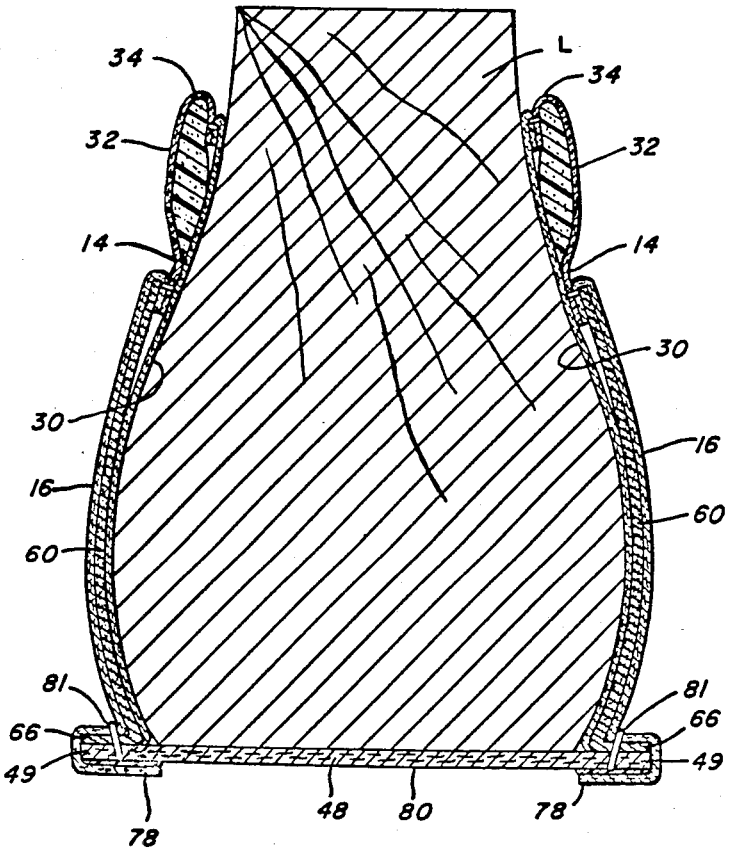

The one piece vamp 14 of the upper extends about the toe area 70 and the side quarters 72 and includes a lasting margin 74 immediately adjacent the feather edge sized to extend under the margin 76 of the forepart 46 of insole 44 as shown in FIG. 6. Similarly, the lining 30 has a lower margin 77 which may be wrapped under the insole margin 76. Foxing 16 is provided with a lasting margin 78 which extends over the flange 66 of the counter and is wrapped under the wide margin 49 of insole back part 48 as shown in FIG. 7.

As indicated above, the shoe construction of the present invention is cement lasted at the forepart and stitched down at the rear part to achieve the several advantages stated. FIG. 6 shows the lasting margin 74 of the forepart of the upper wrapped under the margin 76 of the insole forepart 46 immediately adjacent the feather edge and cemented in place. FIG. 7 shows that the stiff flange 66 of molded counter 62 and the lower portion of the foxing 16 are turned outwardly from the feather edge over the wide margin 49 of the insole back part 48 and are stitched together by stitching 66, while the extreme edge 78 of the margin of the foxing 16 is wrapped under the margin 49 of the insole back part 48 and cemented down in place.

In the manufacture of the shoe, the upper consisting of the vamp 14, foxing 16, eye stay 24 and tongue 26 along with the lining 30 are assembled in the manner shown and described, and thereafter the counter 60 is inserted into the back part of the upper between the foxing 16 and lining 30. The back part of the upper is then molded and flanged out at the bottom to form the flange 66 in the counter and the outward flare in the foxing 16 by means of heat and pressure with the aid of male and female molds.

Figure 4:
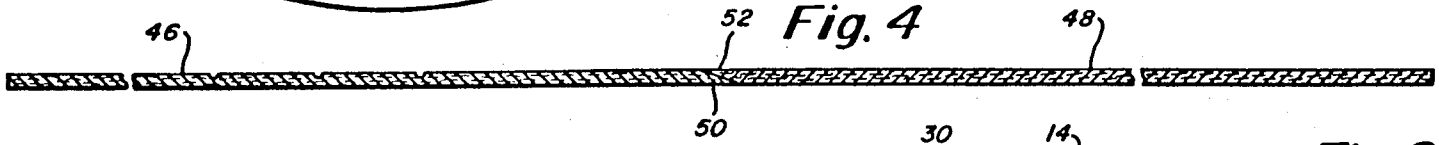
FIG. 4 is a fragmentary cross-sectional view of the insole taken on section line 4—4 of FIG. 3.

As a separate and independent process, the insole 44 is formed by cementing together the flexible forepart 46 and the firm back part 48 along their respective margins as shown in FIG. 4.

After the upper 10 and insole 44 are formed in the manner described, the insole 44 and upper 10 are precemented about their edges with a ribbon of cement approximately one-half inch wide.

The insole 44 is next tacked to the bottom of the last L with the cement ribbon on the face of the insole away from the last bottom. The forepart of the upper 10 is then cement lasted to the forepart 46 of the insole 44 by wrapping the margin 77 of lining 30 and the margin 74 of the vamp tightly over the bottom margin 76 of the insole as suggested in FIG. 6. The bond between the margins is very quickly formed by the cement ribbons applied to the margins before lasting.

Next, the lasting margin 78 of foxing 16 and its lining margin, if any, are machine lasted and cemented to the upper surface of the flange 66 of counter 60, and then the margin of the foxing and the flange 66 of the counter are stitched to the upper surface of the wide margin 49 of the back part 48 of insole 44 by stitching 81, as suggested in FIG. 7. The side lasting is completed by blending in the forepart cement lasting with the back part stitch lasting at the arch area. This later operation may best be accomplished by hand.

The outer edge of the foxing margin 78 is next wrapped around the edge of margin 49 of back part 48 of insole 44 onto the bottom surface 80 and cemented down to form a clean folded edge. Finally, the shoe assembly is completed by roughing the bottom surface of the insole 44 and the margins of the upper on that surface, and cementing the midsole 42 and outsole 40 in place. The midsole 42 and outsole 40 may be made of any material that provides suitable cushioning and traction for the wearer and of course has proper wear characteristics. The outsole may include a toe cap 84 as suggested in FIG. 1, and the midsole may be wedge-shaped to provide the appropriate lift for the foot. A sock lining (not shown) is also included in the shoe, which covers the upper surface of the insole and may provide additional cushioning for the foot.

From the foregoing description, it will be appreciated that a very comfortable shoe is provided which has great forepart flexibility in a fore and aft direction while providing very substantial side to side stability so as to prevent roll over and twisting. The stiff back part of the insole provides a firm platform for the counter, and the outwardly extending flange 66 of the counter increases the effective width of the shoe at the heel to further resist roll over as compared to conventionally cement lasted lightweight athletic shoes.

Having described this invention in detail, those skilled in the art will appreciate that numerous modifications may be made thereof without departing from the spirit of this invention. Therefore, it is not intended that the scope of this invention be limited to the single embodiment illustrated and described. Rather, the scope of this invention is to be determined by the appended claims and their equivalents.

We claim:

1. A shoe comprising a sole having a forepart and a back part, said back part being relatively stiff and having a wide outwardly extending lasting margin extending about its periphery;

and an upper having a forepart and rear part, a molded counter with a stiff outwardly extending flange and covered on the outside by the rear part, said rear part having a lower margin which extends outwardly over the flange of the counter and is turned under the lasting margin of the back part of the sole;

stitching joining the lasting margin of the back part of the sole to the flange of the counter and the lower margin of the rear part overlying the flange, said forepart of the upper having a margin which is turned under from the feather edge and is secured to the forepart of the sole.

2. A shoe as defined in claim 1 wherein the sole includes an insole having a forepart made of a relatively flexible material and a rear part of a relatively stiff material.

3. A shoe as defined in claim 2 wherein the forepart and rear part of the insole are joined just rearwardly of the portion of the insole which underlies the ball of the foot.

4. A shoe comprising a sole and an upper;

said sole including an insole having a forepart, shank area and back part and having a wide outwardly extending lasting margin extending about the back part and terminating at its forward portion at the shank area;

said upper having a vamp, foxing and a stiff counter;

an outwardly extending stiff lasting flange forming part of the counter positioned in face to face relationship with the wide lasting margin of the insole, and said foxing having an outwardly extending lasting margin overlying the flange of the counter;

stitching joining the foxing lasting margin and lasting flange to the upper surface of the wide lasting margin of the insole for imparting lateral stability to the rear part of the shoe;

said vamp having a lasting margin essentially free of contact with the upper surface of the forepart of the insole and extending under the periphery of the forepart of the insole and lying in face to face relationship with the bottom surface of said insole;

and the lasting margin of the vamp being cement lasted to the bottom surface of the insole to provide substantial fore and aft flexibility to the shoe.

5. A shoe as defined in claim 4 wherein the upper includes a lining stitched at its top to the top of the foxing, said foxing and lining sandwiching the counter.

6. A shoe as defined in claim 4 wherein the foxing beyond the lasting flange of the counter and its own lasting margin has a peripheral portion which extends about the edge of the wide lasting margin of the insole into face to face relationship with the lower surface of the wide lasting margin and is cemented to said lower surface of the wide lasting margin of the insole.

7. A shoe comprising a sole and an upper;

said sole including an insole having a back part, said back part having a wide outwardly extending lasting margin extending about its periphery;

said upper including a forepart and a rear part with a feather edge and a stiff counter;

an outwardly extending stiff lasting flange forming part of the counter positioned in face to face relationship with the wide lasting margin of the insole, and said rear part of said upper having an outwardly extending lasting margin beyond the feather edge overlying the flange of the counter;

stitching joining the lasting margin of the rear part of the upper and the lasting flange of the counter to the upper surface of the wide lasting margin of the insole for imparting lateral stability to the rear part of the shoe;

said upper forepart having an inwardly turned bottom portion secured to the sole to provide substantial fore and aft flexibility to the shoe.

8. A shoe as defined in claim 7 wherein the inwardly turned bottom portion of the upper forepart is immediately adjacent the feather edge.

9. A shoe as defined in claim 7 wherein the upper includes a lining secured at its top to the top of the rear part of the upper, said upper with the lining defining a pocket for the counter.

10. A shoe comprising a sole and an upper;

said sole including an insole having a forepart, shank area and back part, said back part having a wide outwardly extending lasting margin extending about the back part and terminating at its forward portion in the region of the shank area;

said upper having a forepart, rear quarter and a stiff counter;

an outwardly extending stiff lasting flange forming part of the counter positioned in face to face relationship with the wide lasting margin of the insole, and said rear quarter having an outwardly extending lasting margin overlying the lasting flange of the counter;

stitching joining the lasting margin of the rear quarter and lasting flange of the counter to the upper surface of the wide lasting margin of the insole for imparting lateral stability to the rear part of the shoe;

said upper forepart having a lasting margin essentially free of contact with the upper surface of the insole and extending under the periphery of the forepart of the insole;

and the lasting margin of the upper forepart being secured to the sole to provide substantial fore and aft flexibility to the shoe.

11. A shoe comprising a sole and an upper;

said sole including an insole having a back part with a wide outwardly extending lasting margin extending about the back part;

said upper having a vamp, quarters, feather edge and a stiff counter;

an outwardly extending stiff lasting flange forming part of the counter positioned in face to face relationship with the wide lasting margin of the insole, and said quarters having an outwardly extending lasting margin overlying the flange of the counter;

stitching joining the quarters lasting margin and counter lasting flange to the upper surface of the wide lasting margin of the insole for imparting lateral stability to the rear part of the shoe;

and an outsole secured to the bottom of the shoe beneath the insole, said vamp having a lasting margin immediately adjacent the feather edge and turned under at the forepart of the shoe and overlying the outsole to provide substantial fore and aft flexibility to the shoe.

12. A shoe as defined in claim 11 wherein the outwardly extending lasting margin of the quarters has an outermost portion which is turned under the margin of the insole, and is cemented to the sole.

13. A shoe as defined in claim 11 wherein the insole has a forepart, and the lasting margin of the vamp is secured beneath the bottom surface of the insole.

14. A shoe as defined in claim 13 wherein the insole is flexible at the forepart and relatively stiff at the backpart.

15. A shoe as defined in claim 11 wherein the quarters include foxing which extends about the back of the shoe.

16. A shoe as defined in claim 15 wherein a lining is secured to the upper edge of the quarters, and the lining and foxing define a pocket for the counter.

* * * * *